US005458707A

United States Patent [19]

Delagey et al.

[11] Patent Number: 5,458,707

[45] Date of Patent: Oct. 17, 1995

[54] GASSED EMULSION EXPLOSIVES

[75] Inventors: Mark O. Delagey; Hermanus J. De Klerk, both of Secunda, South Africa

[73] Assignee: Sasol Chemical Industries (Proprietary) Limited, Johannesburg, South Africa

[21] Appl. No.: 335,055

[22] Filed: Nov. 7, 1994

[30] Foreign Application Priority Data

Nov. 18, 1993 [ZA] South Africa ..... 93/6052
Dec. 10, 1993 [ZA] South Africa ..... 93/9275

[51] Int. Cl.[6] ..... C06B 31/30

[52] U.S. Cl. ..... 149/60; 149/2; 149/46

[58] Field of Search ..... 149/60, 46, 2

[56] References Cited

U.S. PATENT DOCUMENTS 4,936,931 6/1990 Nguyen et al. ..... 149/2
4,936,932 6/1990 Nguyen ..... 149/2

*Primary Examiner*—Donald P. Walsh
*Assistant Examiner*—Anthony R. Chi
*Attorney, Agent, or Firm*—Victor E. Libert; Frederick A. Spaeth

[57] ABSTRACT

A PIBSA based emulsion explosive including an ester of orthophosphoric acid, preferably made from long chain alcohols having from 6 to 18 carbon atoms. The explosive may be gassed chemically or mechanically and can be used in the manufacture of heavy ANFO.

23 Claims, No Drawings

GASSED EMULSION EXPLOSIVES

BACKGROUND OF THE INVENTION

1. Field of the Invention

This invention relates to gassed emulsion explosives.

2. Description of Related Art

Emulsion explosives usually consist of a water-in-oil emulsion, containing oxidisers. Historically they were manufactured with the aid of emulsifiers based on sugar esters. More recently the generic family of PIBSA (polyisobutylenesuccinicanhydride) based emulsifiers found application in this respect. PIBSA based emulsifiers result in more stable emulsions, which can be made under a wide range of process parameters, and which exhibit the required shelf life.

It is common practice in the field of emulsion explosives to manipulate the density of the explosive by controlled gassing thereof. Gassing can be accomplished by chemical or mechanical means.

Chemical gassing can be based on a number of reactions, such as the reaction of a metal with a strong acid to form hydrogen, but the most commonly used reaction is the catalytic decomposition of sodium nitrite in an acid medium to form nitrogen.

PIBSA based emulsifiers are generally able to react with the acid required for chemical gassing, usually with a deleterious effect on the emulsification properties of the emulsifier. The commonly used chemical gassing reaction can thus not be used to gas the known PIBSA based explosive emulsions.

It is also known that porous ammonium nitrate prills (PPAN), which are used in an admixture with fuel oil to form ammonium-nitrate-fuel-oil explosives (ANFO), can be stabilised with naphthalene sulphonate against the thermal degradation of the prill at 32° C. Such a sulphonate is a surfactant which has an opposite emulsifying action to the emulsifiers commonly used in emulsion explosive technology. The customary admixture of ANFO, made from prills stabilised in this way, with emulsion explosives to form a product commonly known in the explosives art as "Heavy ANFO", results in the degradation of the emulsion part of the admixture and the failure of the explosive due to the incompatibility of the sulphonate and the emulsifier.

SUMMARY OF THE INVENTION

It is an object of this invention to provide a PIBSA-based emulsion explosive with which the aforesaid problems can be overcome or at least minimised.

According to the invention a PIBSA based emulsion explosive is provided which includes a suitable ester of orthophosphoric acid, herein referred to as a "phosphate ester".

Applicant has found that such an explosive can be gassed within a reasonable time (less that 30 minutes at 10° C.), and that it remains stable for at least 28 days after being charged into a drill hole and kept there at ambient temperatures (−10° C. to 40° C.).

Preferably the phosphate ester is a mixture of suitable mono- and di-esters of orthophosphoric acid.

Preferably the mixture of esters comprises compounds with the following configuration:

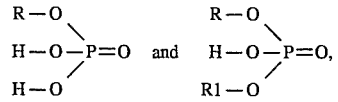

wherein R and R1 comprise carbon chains with from 6 to 18 carbon atoms, with R and R1 being the same or different.

Applicant has found the most suitable mono- and di-esters to be those formed from alcohols wherein R comprises a carbon chain of from 7 to 9, and R1 from 10 to 18 carbon atoms. Most preferably R comprises a carbon chain of 8, and R1 one of from 12 to 16 carbon atoms.

The following compounds may accordingly be present in a typical ester mixture according to the invention:

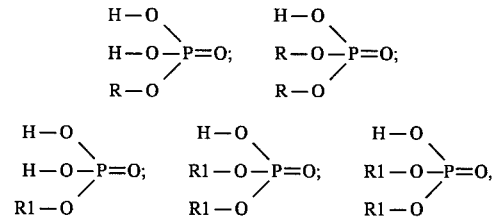

wherein R and R1 have the same values as given above.

Applicant has found that such a mixture may also contain C7, C9, C11 and C17 carbon chains as well as some unreacted orthophosphoric acid and phosphoric acid dimers.

The concentration of the phosphate ester in the total explosive formulation is preferably between 0.02 and 2.0%, more preferably between 0.05 and 0.7% mass per mass.

The phosphate ester can be added at any step or to any of the two phases of the water-in-oil emulsion explosive, but preferably the phosphate ester is dissolved in the oil phase of the explosive before emulsification.

Further, according to the invention, the explosive according to the invention may include an additional emulsifier to the main PIBSA based emulsifier in a concentration less than that of the PIBSA based emulsifier. This emulsifier, which acts as a co-emulsifier, preferably consists of a fatty acid ester of sorbitan, more specifically sorbitan mono-oleate (SMO).

DETAILED DESCRIPTION OF THE INVENTION

Applicant has found the following with such an emulsion explosive containing a phosphate ester according to the invention:

1. If the phosphate ester is present in excess compared to the PIBSA based emulsifier, it can act as an emulsifier in its own right, forming an oil-in-water emulsion but, when it is present in the preferred minor percentage, it acts as a co-emulsifier for the water-in-oil emulsion which comprises the emulsion explosive.

2. If a gassing solution is added to the emulsion explosive without the addition of supplementary acid, the resultant gas evolution is due to the presence of free orthophosphoric acid and dimers thereof, as well as to the mono-esters which contain free OH groups and, to a lesser extent, to the single OH group of the di-esters.

3. The rate of gassing of the emulsion explosive is acceptable down to a temperature of 10° C.; the gassing to reduce the density of the explosive taking place within 30 minutes at a pH of 5. This pH is preferably obtained by the addition of either nitric acid or ammonium hydroxide to the aqueous oxidiser phase, but it can also be attained by using any other suitable acid or alkali.

4. The gassed emulsion explosive retains its explosive and rheological properties for at least 28 days after admixing with sulphonate stabilised PPAN prills and pumped into a borehole. This is referred to as a 28 day sleep time.

5. The gas bubbles are smaller and of a more uniform size distribution than in conventionally gassed, SMO based, emulsion explosives. The gas bubbles retain their size even after applying a standardised stirring test which leads to the collapse of bubbles in unstabilised emulsion explosives.

6. Stabilization of the gas bubbles is independent of the method by which the bubbles have been produced. The method could be by chemical gassing as described, or by mechanical means, e.g., by beating in bubbles with an aerating stirring mechanism.

7. The stabilisation effect is the most pronounced when the PIBSA has a molecular weight of between 500 and 1300 and when the ester derivative is synthesised with tri-ethanolamine.

The gassing reagent is preferably based on the catalytic acid decomposition of sodium nitrite. It can consist of a mixture of sodium nitrite, urea or thiourea and water in suitable concentrations. In a non-limiting example the gassing reagent may comprise a mixture of a thiourea sodium nitrite and water in the mass ratio of 5:10:85.

The gassing reagent can be added to the explosive as an aqueous solution or as a water-in-oil emulsion. If the latter method is used, even more uniform gas bubbles are obtained. If this emulsion also contains the phosphate ester, the greatest uniformity and stabilisation of bubbles is obtained.

Applicant has also found that in so far as such gassing is concerned, the phosphate ester serves as acid catalyst for the gassing reaction from sodium nitrite and that it also serves as a buffer and source of acid to facilitate gassing at pH5, which is neutral for an ammonium nitrate solution.

Preferably the composition of the gassed emulsion explosive according to the invention, expressed in mass percentages, is as follows:

| | GENERAL | PREFERRED | MOST PREFERRED | |
|---|---|---|---|---|
| Calcium nitrate | 0–35% | 0–15% | 0% | 0% |
| PIBSA | 0.1–2.0% | 0.1–1.2% | 0.69% | 0.81% |
| SMO | 0.0–2.0% | 0.1–0.6% | 0.30% | 0.0% |
| Phosphate ester | 0.1–2.0% | 0.1–07% | 0.31% | 0.31% |
| Oil (or oil and wax) | 2.5–20% | 6–9% | 6.8% | 6.98% |
| Water | 1–24% | 7–20% | 18.0% | 18.0% |
| Gassing reagent | 0.4–5% | 0.8–2% | 1.7% | 1.7% |
| Ammonium nitrate | Balance | Balance | 72.2% | 72.2% |

The pH range is generally from 2.0 and 6.5, preferably 3.6–5.8, and most preferably 5.

It has been found that the most preferred formulation given above gasses particularly well.

Applicant has also found that if the explosive composition includes PPAN, stabilised in any manner known in the explosives and including naphthalene sulphonate stabilised PPAN to form heavy ANFO, such PPAN is compatible with the emulsifier being utilised, either with or without the addition of calcium nitrate to the oxidiser solution.

The invention accordingly also includes within its scope such an explosive composition including such PPAN, either on its own or with fuel oil to form ANFO.

The invention furthermore also includes within its scope a mixture of such a gassed emulsion explosive and 0–90% (mass percent) of either ammonium nitrate prills or ANFO made from ammonium nitrate prills and fuel oil in the typical ratio of 94:6 stabilised in any way known in the explosive art, to form gassed heavy ANFO.

When so admixed with 40% ANFO, the resultant heavy ANFO has a sleep time of at least 28 days.

The phosphate ester in this instance can be added to the fuel oil component of the ANFO.

It will be appreciated that the invention also includes within its scope a method of manufacturing gassed emulsion explosives and gassed heavy ANFO as described herein.

It will be appreciated further that there are no doubt many variations in detail possible with a gassed emulsion explosives and/or gassed heavy ANFO according to the invention without departing from the spirit and/or scope of the appended claims.

What is claimed is:

1. A PIBSA based emulsion explosive including an ester of orthophosphoric acid.

2. The emulsion explosive of claim 1 wherein the ester is a mixture of mono- and diesters of orthophosphoric acid.

3. The emulsion explosive of claim 1 wherein the ester is a mixture of esters comprising compounds with the following configuration:

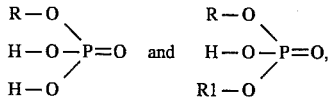

wherein R and R1 comprise carbon chains with from 6 to 18 carbon atoms, with R and R1 being the same or different.

4. The emulsion explosive of claim 3 wherein the esters are formed from alcohols in which R comprises a carbon chain of from 7 to 9 and R1 from 10 to 18 carbon atoms.

5. The emulsion explosive of claim 3 wherein the esters are formed from alcohols in which R comprises a carbon chain of 8 and R1 from 12 to 16 carbon atoms.

6. The emulsion explosive of claim 1 wherein the ester comprises a mixture of the following compounds:

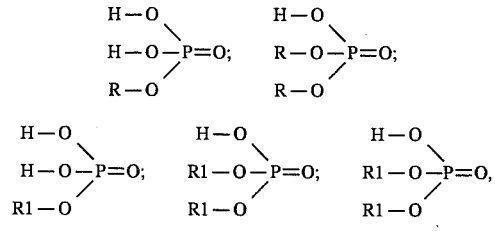

wherein R comprises a carbon chain of 8 and R1 from 12 to 16 carbon atoms.

7. The emulsion explosive of claim 1 wherein the concentration of the ester in the total explosive formulation is from 0.02 to 2.0% mass/mass.

8. The emulsion explosive of claim 1 wherein the concentration of the ester in the total explosive composition is from 0.05 to 0.7% mass per mass.

9. The emulsion explosive of claim 1 including an additional emulsifier to the main PIBSA based emulsifier in a concentration less than that of the PIBSA based emulsifier.

10. The emulsion explosive of claim 9 wherein the additional emulsifier consists of a fatty acid ester of sorbitan.

11. The emulsion explosive of claim 9 wherein the additional emulsifier comprises sorbitan mono-oleate.

12. The emulsion explosive of claim 1 which is gassed.

13. The emulsion explosive of claim 12 wherein the gassing is effected chemically.

14. The emulsion explosive of claim 12 wherein the gassing is effected mechanically.

15. The emulsion explosive of claim 1 including a gassing reagent which operates on the catalytic acid decomposition of sodium nitrite.

16. The emulsion explosive of claim 15 wherein the gassing reagent comprises a mixture of sodium nitrite, urea or thiourea and water.

17. The emulsion explosive of claim 15 wherein the gassing reagent comprises a mixture of a thiourea, sodium nitrite, and water in the mass ratio of 5:10:85.

18. A gassed emulsion explosive having the following constitution expressed in mass percentages: calcium nitrate-0–35%; PIBSA-0.1–2.0%; SMO- 0.0–2.0%; phosphate ester-0.1–2.0%; oil- 2.5–20%; water-1–24%; gassing reagent-0.4–5% and the balance ammonium nitrate, and of which the pH is between 2.0 and 6.5.

19. A gassed emulsion explosive having the following constitution expressed in mass percentages: calcium nitrate-0–15%; PIBSA-0.1–1.2%; SMO- 0.1–0.6%; phosphate ester- 0.1–0.7%; oil-6–9%; water-7–20%; gassing reagent-0.8–2% and the balance ammonium nitrate, and of which the pH is between 4.5 and 5.8.

20. A gassed emulsion explosive having the following constitution expressed in mass percentages: calcium nitrate-0%; PIBSA-0.69%; SMO- 0.30%; phosphate ester-0.31%; oil-6.8%; water- 18.0%; gassing reagent-1.7% and ammonium nitrate- 72.2%; and of which the pH is 5.

21. A gassed emulsion explosive having the following constitution expressed in mass percentages: calcium nitrate-0%; PIBSA-0.81%; SMO- 0.0%; phosphate ester-0.31%; oil- 6.98%; water-18.0%; gassing reagent- 1.7% and ammonium nitrate-72.2%; and of which the pH is 5.

22. The gassed emulsion explosive of claim 1 together with 0–90% (mass percent) of one of the group of components including ammonium nitrate prills and ANFO made from ammonium nitrate prills and fuel oil in the ratio of 94:6 to form heavy ANFO.

23. The gassed heavy ANFO of claim 22 including naphthalene sulphonate stabilised PPAN.

* * * * *